US008252999B2

(12) United States Patent
Deck

(10) Patent No.: US 8,252,999 B2
(45) Date of Patent: Aug. 28, 2012

(54) STRINGED INSTRUMENT IMPROVEMENT

(76) Inventor: Brent Douglas Deck, Kansas City, KS (US)

( * ) Notice: Subject to any disclaimer, the term of this patent is extended or adjusted under 35 U.S.C. 154(b) by 0 days.

(21) Appl. No.: 12/283,668

(22) Filed: Sep. 15, 2008

(65) Prior Publication Data

US 2010/0064877 A1 Mar. 18, 2010

(51) Int. Cl.
*G10D 3/00* (2006.01)

(52) U.S. Cl. ..... 84/313

(58) Field of Classification Search ..... 84/313
See application file for complete search history.

(56) References Cited

U.S. PATENT DOCUMENTS

| | | | | | |
|---|---|---|---|---|---|
| 2,741,146 | A | * | 4/1956 | Fender | 84/313 |
| 3,136,198 | A | * | 6/1964 | Smith et al. | 84/312 P |
| 3,241,418 | A | * | 3/1966 | Fender | 84/313 |
| 3,411,394 | A | * | 11/1968 | Jones | 84/313 |
| 3,500,711 | A | * | 3/1970 | Fender | 84/313 |
| 3,580,124 | A | | 5/1971 | Mancini | |
| 3,990,341 | A | * | 11/1976 | Pace, Sr. | 84/313 |
| 4,141,271 | A | * | 2/1979 | Mullen | 84/312 P |
| 4,285,262 | A | | 8/1981 | Scholz | |
| 4,397,212 | A | | 8/1983 | Carson | |
| 4,512,232 | A | * | 4/1985 | Schaller | 84/313 |
| 4,576,080 | A | | 3/1986 | McLellan | |
| 4,648,304 | A | * | 3/1987 | Hoshino et al. | 84/313 |
| 4,704,936 | A | * | 11/1987 | Steinberger | 84/313 |
| 4,903,568 | A | | 2/1990 | Itoh | |
| 4,951,543 | A | | 8/1990 | Cipriani | |
| 4,955,275 | A | | 9/1990 | Gunn | |
| 5,198,601 | A | | 3/1993 | McCabe | |
| 5,747,713 | A | * | 5/1998 | Clement | 84/313 |
| 5,783,763 | A | * | 7/1998 | Schaller et al. | 84/313 |
| 5,965,831 | A | | 10/1999 | McMabe | |
| 5,986,190 | A | * | 11/1999 | Wolff et al. | 84/297 R |
| 6,100,459 | A | * | 8/2000 | Yost | 84/313 |
| 6,175,066 | B1 | | 1/2001 | McCabe | |
| 6,825,406 | B2 | | 11/2004 | Thidell | |
| 6,875,911 | B2 | * | 4/2005 | Schryer | 84/313 |
| 6,891,094 | B2 | | 5/2005 | McCabe | |
| 6,972,360 | B1 | * | 12/2005 | Ekin | 84/312 R |
| 6,989,483 | B2 | | 1/2006 | Ramsay | |
| 7,189,908 | B2 | * | 3/2007 | Lavineway | 84/313 |
| 7,339,102 | B2 | | 3/2008 | Folmar et al. | |
| 7,459,619 | B2 | * | 12/2008 | Gawenda | 84/313 |
| 7,479,592 | B1 | * | 1/2009 | Slavik | 84/313 |
| 7,772,470 | B1 | * | 8/2010 | Olsen | 84/313 |
| 2002/0043147 | A1 | * | 4/2002 | Herbold | 84/313 |
| 2006/0179998 | A1 | | 8/2006 | Sperzel | |
| 2010/0064877 | A1 | * | 3/2010 | Deck | 84/313 |
| 2011/0036228 | A1 | * | 2/2011 | Deck | 84/313 |

FOREIGN PATENT DOCUMENTS

| | | |
|---|---|---|
| CA | 2077736 | 9/1994 |
| WO | PCT/US1996/012315 | 7/1996 |
| WO | PCTUS2004/043599 | 8/2005 |
| WO | PCTUS2008/053910 | 2/2008 |
| WO | PCTUS2010/27736 | 3/2010 |

OTHER PUBLICATIONS

U.S. Appl. No. 11/776,783, filed Jul. 12, 2007, Steinberger.
U.S. Appl. No. 12/842,028, filed Jul. 22, 2010, CIP of the present app.

* cited by examiner

*Primary Examiner* — Elvin G Enad
*Assistant Examiner* — Robert W Horn

(57) ABSTRACT

This invention relates to improvements to a stringed musical instrument, and more particularly to guitar design for use with transposing vibrato mechanisms.
Vibrato devices for guitars are known. The present device and method improve the ability to of a player to bend entire chords in a manner that maintains harmonic relationship between the individual strings.

24 Claims, 9 Drawing Sheets

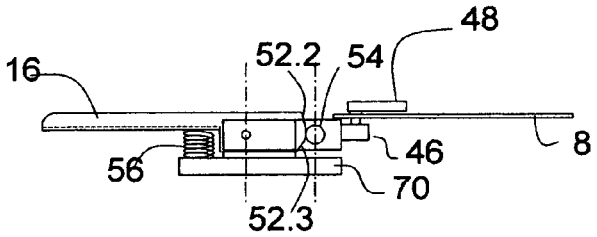
Fig 9J
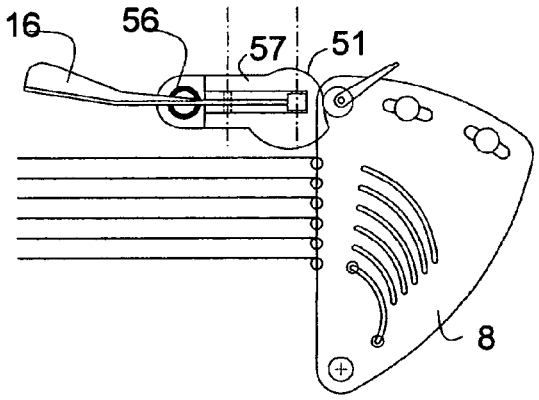
Fig 9D
Fig 9E
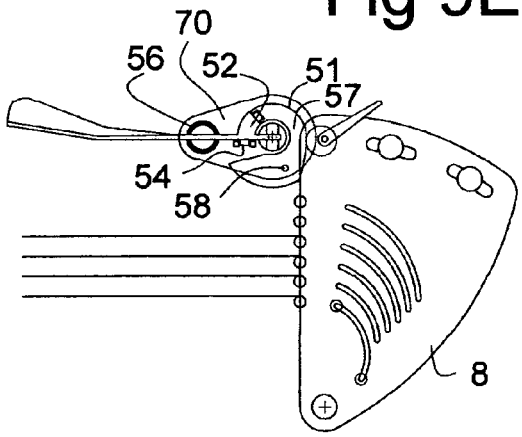
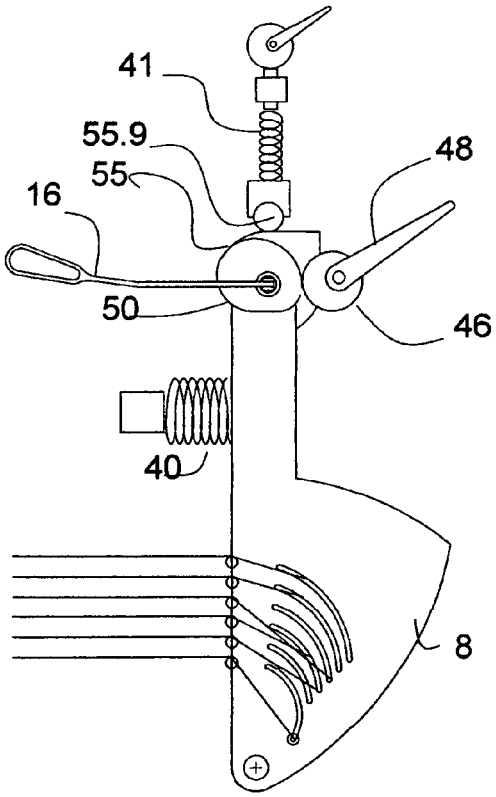
Fig 9F

Fig 10A
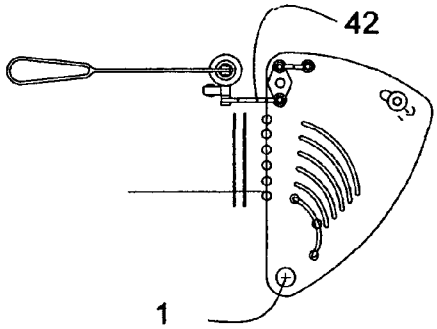
Fig 10B
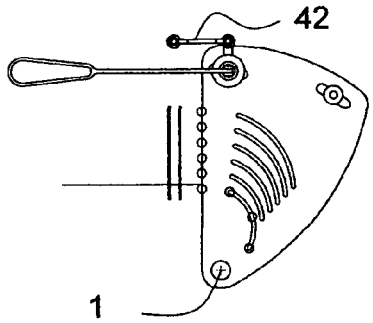
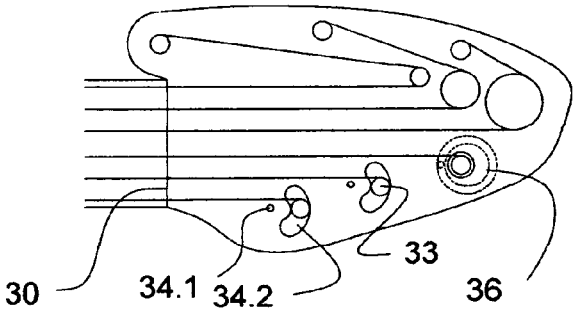
Fig 11A
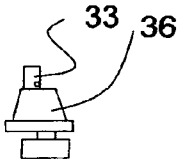
Fig 11B
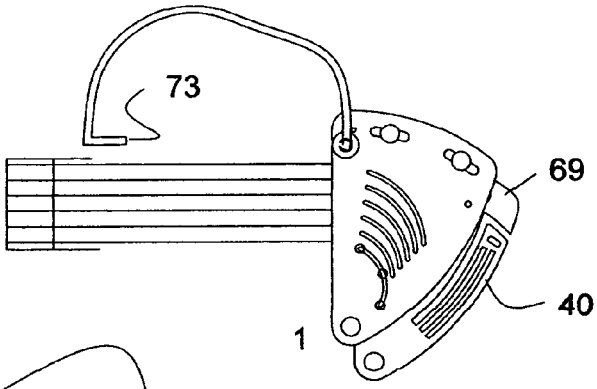
Fig 12A
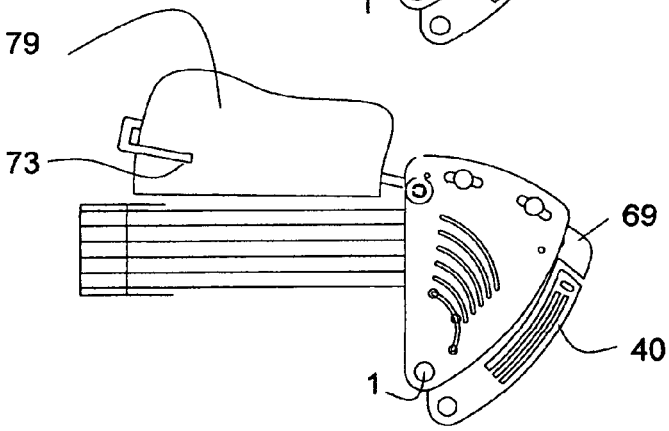
Fig 12B

STRINGED INSTRUMENT IMPROVEMENT

This invention claims priority benefit of provisional application 60/960,075 filed Sep. 14, 2007.

FIELD OF INVENTION

The present invention relates to devices which enhance the expressive qualities of stringed musical instrument by empowering the artist to "bend" notes and chords in a harmonic manner.

BACKGROUND

Non-harmonic vibrato devices are known, typified by U.S. Pat. No. 2,741,146, which allows the musician to change the tension on all guitar stings in unison by activating a lever, without correcting for relative pitch between strings.

Subsequent devices, typified by Jones, U.S. Pat. No. 3,411,394, correct pitch by varying the length of a crank arm or the radius of a string bearing cam. These devices suffer from one or more of the shortcomings of imprecise geometry, expressive difficulty, lack of range, tuning difficulty, tuning instability.

Methods previously used to stabilize a vibrato, such as cam locks, or flats on activating cams, interfere with the smooth expressive motion of the vibrato.

SUMMARY

The present invention improves the state of the art by utilizing tangential motion of string guides in a configuration that is significantly more accurate in pitch correction than the prior art. The guides are fixed relative to a pivoting tailpiece and cause the strings to be stretched or relaxed harmonically when the tailpiece is rotated.

The enhanced accuracy allows the device to be made smaller than prior devices without loss of performance. When built at a larger scale, its geometric accuracy reduces required setup accuracy. Accuracy of the device is further enhanced by proper attention to string clamping and neck rigidity.

The dual axis control allows a musician to sweep easily from "bend" to "dive" (sharp to flat) while using the muscles on only one side of the hand and wrist. A cam-enabled return spring maintains neutral tuning when the device is released without adversely affecting the action of the device.

OBJECTS OF THE INVENTION

1) It is an object of the invention to provide an expressive vibrato device which bends chords while accurately maintaining relative pitch.
2) It is an object of the invention to provide a means of operating the device which allows smooth transitions from sharp to flat.
3) It is an object of the invention to provide a means of operating the device which provides tonal stability when the device is inactive.
4) It is an object of the invention to provide a means of operating the device which requires less effort and coordination than the prior art.
5) It is an object of the invention to provide a device which is easier to tune and maintains tune better than the prior art.

DRAWINGS

FIG. 9A through 9E are top views of various control cam embodiments on a flat plate vibrato tailpiece.

FIG. 9J is a side view of the tailpiece assembly of FIG. 9D.

FIGS. 10A and 10B are top views of various control link arm embodiments on a flat plate vibrato tailpiece.

FIG. 11A is an exaggerated schematic top view of various improvements to a tuning head, including moveable tuning posts and tortured string paths.

FIG. 11B is an exaggerated schematic side view of a tuning post with eccentric mounting means.

FIG. 12 is a top view of a vibrato assembly for retrofit to an existing guitar body.

Figure 3A:
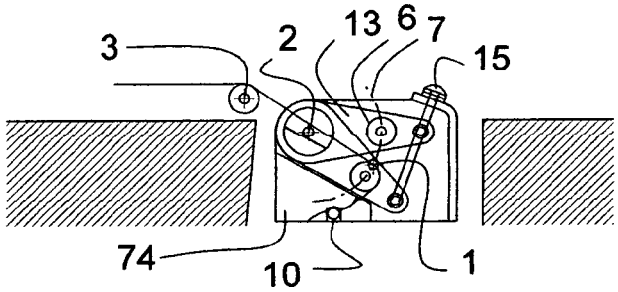
FIG. 3 is a side view of a vibrato mechanism with rotational axis parallel to plane of strings.
Figure 3B:
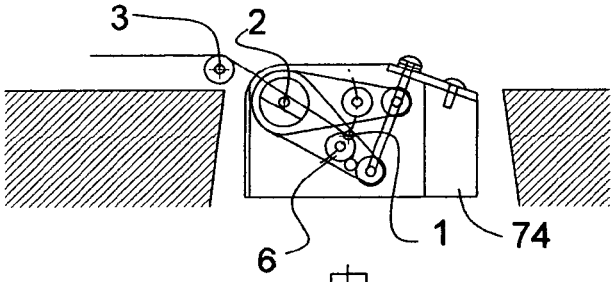
Figure 3C:
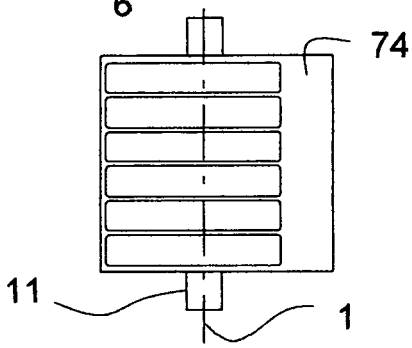
Figure 8A:
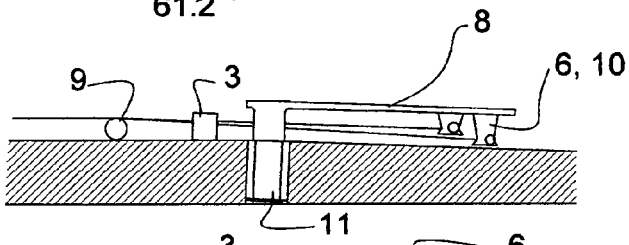
FIG. 8A through 8F are side views of a flat plate tailpiece with axis perpendicular to string plane and body.
Figure 8B:
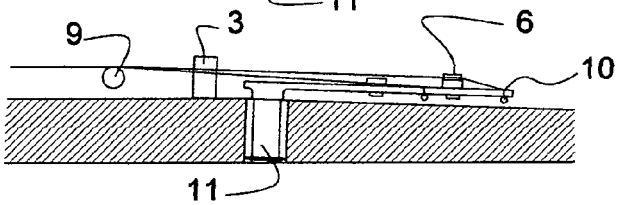

DESCRIPTION a) A main feature of the invention shown in FIGS. 3 and 4 is a pivoting main vibrato member 8 (a moveable tail piece) holding in fixed relation to each other a group of string anchors 10, and optionally a separate group of string guides 6. The guides are preferably cylindrical rotating string rollers or posts with axes parallel to the pivot axis 1 of the main member, but may be any shape or construction which serves the purpose described, and the string anchors themselves may be incorporated into the guides, as illustrated in FIGS. 3B and 8A. The radius of the guide preferably reduces the cyclic bending stress at the string anchor due to motion of the vibrato mechanism.

Figure 4A:
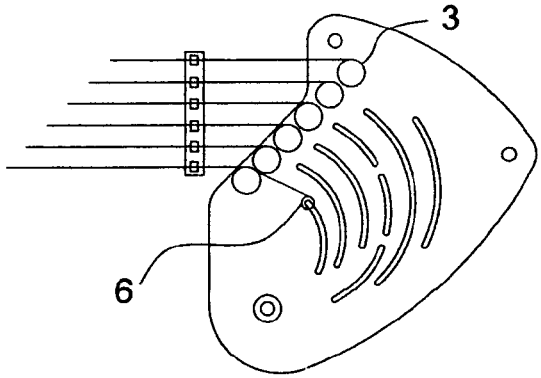
FIG. 4 is a top view of a vibrato mechanism with rotational axis perpendicular to plane of strings.
Figure 8C:
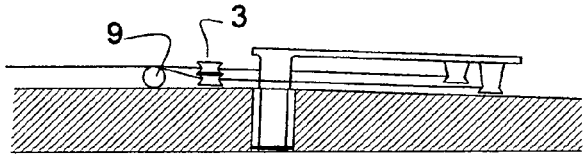
Figure 8D:
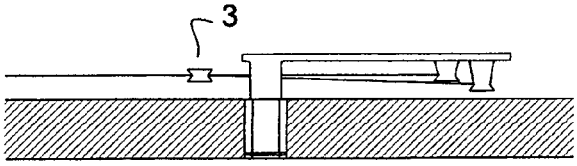
Figure 8E:
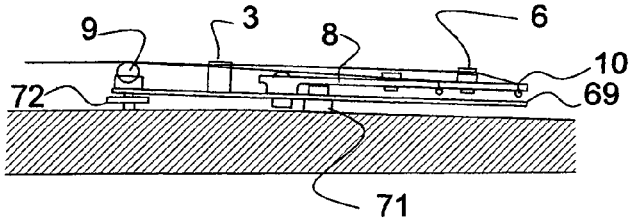
Figure 8F:
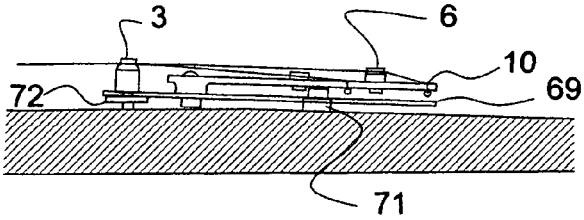

String bearing means 3, providing for a preferably slight change of string direction, may serve as the bridge, supporting one playable end of the string, as in FIGS. 3 and 8F Alternatively as in FIGS. 4A and 8A, bridge means 9, separate from string bearing means 3, may be employed.

Either the guides or the string bearing means may be notched or contoured to constrain the string axially, as illustrated in FIGS. 8C and 8D. Of additional benefit, notches shaped to support the circumference of the string cross section will reduce sheer stresses on the string under tension.

Figure 1A:
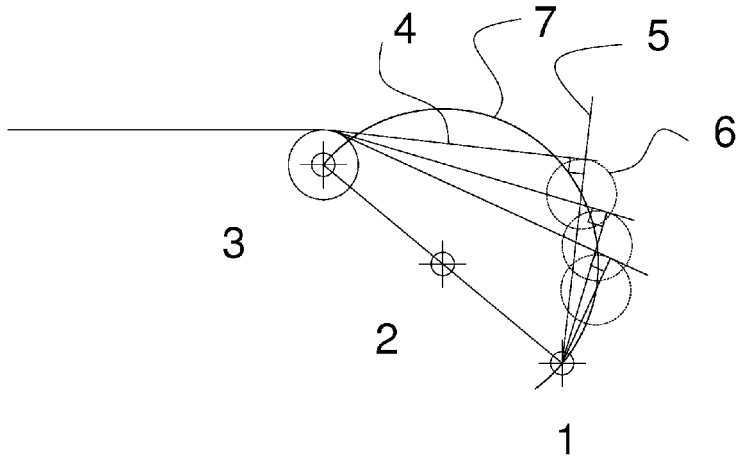
FIG. 1 is a schematic showing geometric construction of string guide path.
Figure 1B:
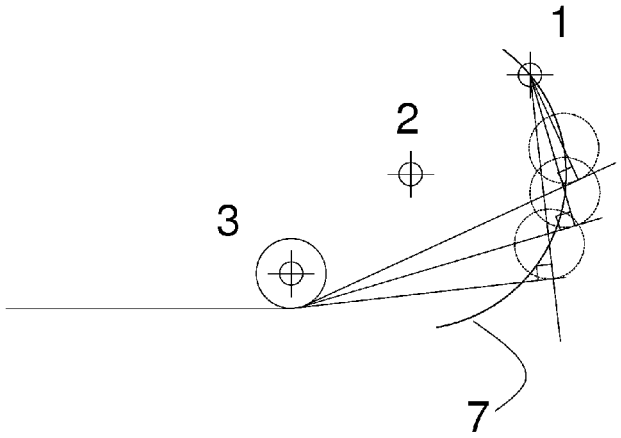
Figure 1C:
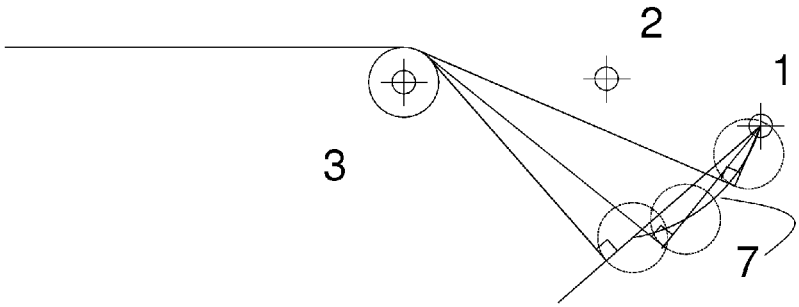

Referring to FIG. 1A, the guides 6 are preferably positioned on the main member so that, at rest, any line 5 radiating from the pivot axis 1 to the center of curvature of any string's guide surface 6 will intersect the suspended string axis 4 at a substantially right angle. That right angle is assured at rest, regardless of adjustment, by constraining the guides to an arcuate path 7, and fixed with respect to said main rotating member. The arc for any such arcuate path may be constructed through the centers of any three cylindrical guide surfaces meeting the foregoing requirement, as shown in FIGS. 1A, 1B, and 1C. If the guide surface radius is identical to the string bearing radius, and if the strings are routed to the outer surface of both string guide and string bearing, then the arc will pass through both the bearing axis and the main center of rotation, and be centered 2 on the mid chord between those two axes when the device is at rest, as shown in FIG. 1A.

Rotating the main member about its pivot axis 1 assures that the displacement of each guide is proportional to its distance from the pivot axis 1.

Because of the extremely accurate proportionality of the present invention with respect to the prior art, the unit may be made dimensionally very compact without losing tune.

Because the pitch of a string varies with the square root of the string stretch, and the scale of the invention is large, the invention is robust enough to allow significant deviation from this optimal design without creating excessive transposing errors. Thus any configuration substantially equivalent to the preferred optimal configuration, for example FIG. 5B, falls within the scope of the invention.

The guides 6 may be constrained to the arcuate path, for example, by means of arcuate slots 12 (fitted with t-bolts or t-nuts, for example) or rails on a flat plate as in FIG. 4, or by crank arms 13 as in FIG. 3, rotationally adjustable about a path axis 2 fixed with relation to the main member, preferably resting on journal means (for instance a shaft or knife edge) with center of curvature at path axis 2.

The crank arm configuration of FIG. 3 has the benefit of allowing any guide to be positioned with the string axis 4 near the main pivot axis 1, such that rotating the main member 8 about its axis will have minimal effect on that string's tension. That feature may be achieved in the flat plate example by anchoring that string to the body of the instrument, or to the center of the rotating member 8. Another benefit to the configuration of FIG. 3 is that the rotation axis parallel to the plane of the strings eliminates conflict between strings which is avoided on the plate mechanism of FIG. 8 by the differential notch height in string guides 6.

Figure 5A:
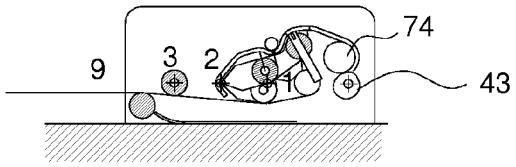
FIG. 5 is a side view of a vibrato mechanism with rotational axis parallel to plane of strings, inverted with respect to FIG. 3.
Figure 5B:
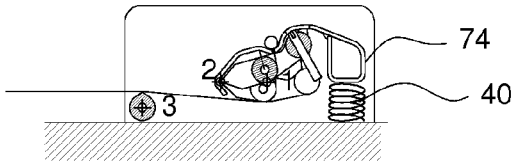
Figure 5C:
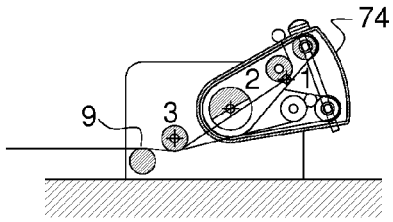

Rotating member 8 preferably has torsion resisting member 74 between opposed endplates, as in FIGS. 3B, 5A, and 5B, or torsion resisting shell structure 74, as in FIG. 5C.

Figure 13:
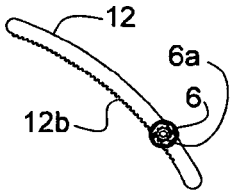
FIG. 13 is a top view of an arcuate guide path slot and guide having gear teeth means for adjustment.
Figure 14A:
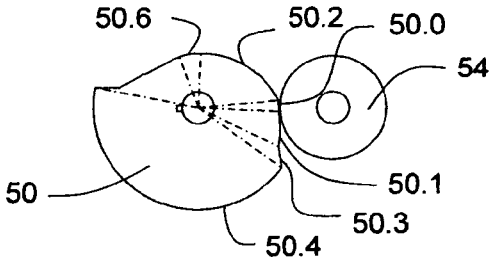
FIG. 14 is a top view of an multi component adjustable actuator cam assembly.
Figure 14B:
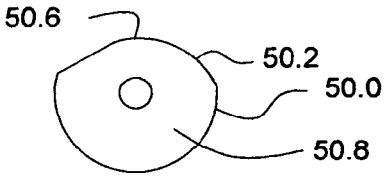
Figure 14C:
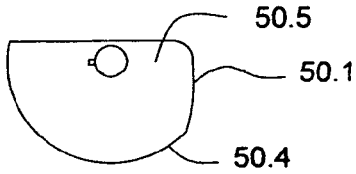
Figure 14D:
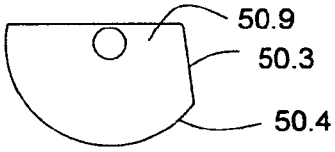
Figure 14E:
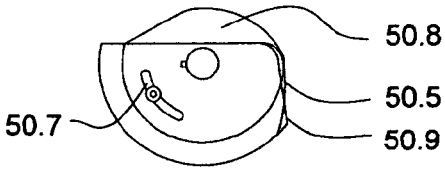
Figure 15:
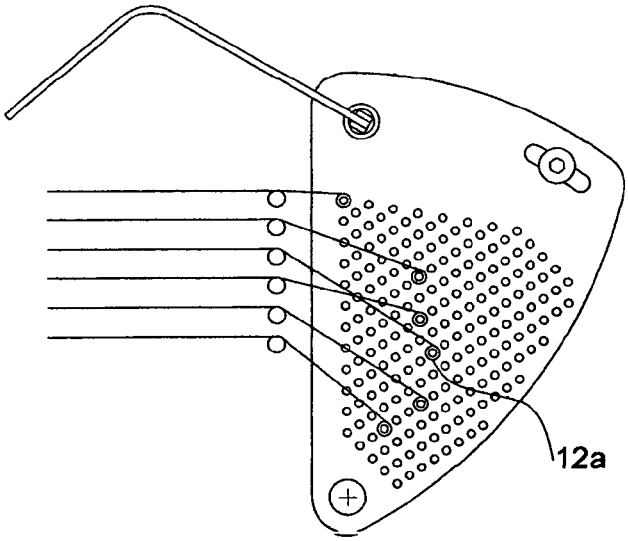
FIG. 15 is a top view of an alternative adjustment means having a multitude of discrete anchor/guide holes 12*a* rather than moveably adjustable guides.

Adjustment of guide position along the arc in either configuration may be by linear adjusting screw 15, an example of which is pictured in FIG. 3. Alternatively, the guides on a flat plate configuration may be manually positioned, or may have an adjustment aid in the form of a wrenchable pinion gear 6*a* preferably concentric with a string guide 6, engaging teeth 12*b*, preferably cut into the edge of the arcuate slot 12, as in FIG. 13.

Having anchor means 10 (for example slots in the edge of plate 8 as in FIG. 4*b*) properly separated from guide means 6, and correctly configured, has the advantage of allowing guide adjustment without an excessive change of string tension or pitch during setup. Additionally, the separate anchor means, as in FIG. 5B, maintain constant direction of force on crank arms 13, thus eliminating need for precision in component manufacture, and allowing adjustment by a simple unidirectional set screw.

Figure 4B:
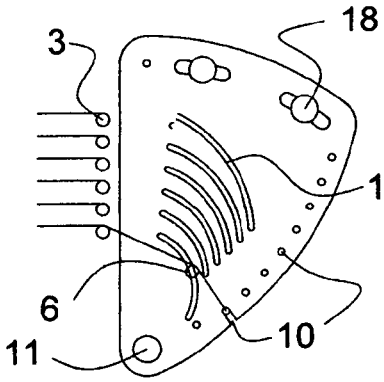
Figure 4C:
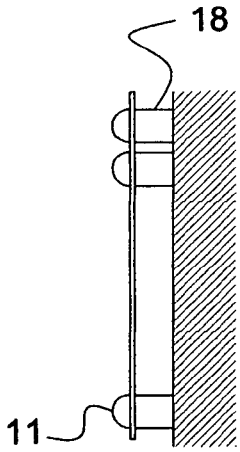

A plate (which may be flat, contoured, or ribbed, for example) rotating about an axis substantially perpendicular to a plane defined by the strings anchored thereto, as in FIG. 4, may be rigidly cantilevered from a rigid pivot shaft 11 in rigid bearing means, as in FIG. 8A. Or, for example, it may pivot nonrigidly about a pin bearing 11, constrained to a fixed plane by separate bearing means about its perimeter, for example one or more shafts 18 extending through 1 or more arcuate slots in the plate as in FIGS. 4B and 4C, having bearing surfaces resisting axial motion of said plate.

Graded markings on said plate, as in FIG. 4A, allow quick setup according to prior records. Additional guides may be positioned for alternate tunings, allowing quick change between tunings without adjustment.

Figure 6A:
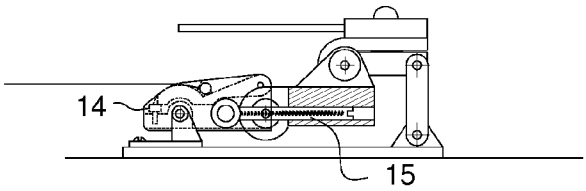
FIG. 6 is a cross sectional side view of a vibrato mechanism having variable length actuator cranks engaging ball receiver crank arms.
Figure 6B:
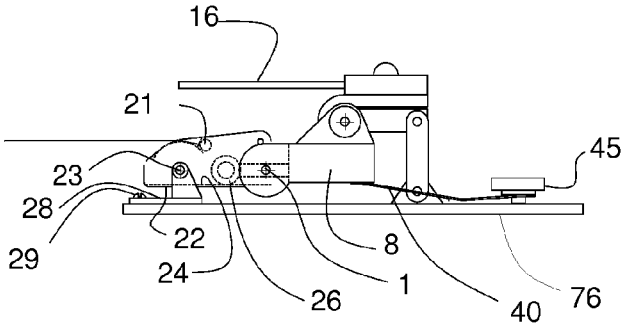
Figure 6C:
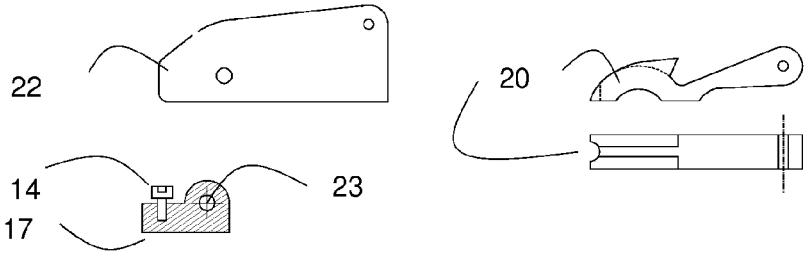

The plate may be made of any material or mass, depending on desired properties, and the mass may be augmented by addition of weights, attached preferably by screw means to the unexposed face of plate. Rigid flat opposing washer means on guide and anchor means, and optionally on additional stiffening screws, in contact with preferably ground flat plate surfaces, may enhance the stiffness of a thin plate by reducing flex at arcuate slots.

b) An alternative mechanism displayed in FIG. 6A-6C comprises for each string, bridge means 20, string end anchor means 21 (preferably in the form of ball cups), fixed to ball crank means 22, which pivot about a "ball crank axis" 23 preferably parallel to said string plane.

Actuator crank means 8 rigidly supports a group of preferably cylindrical or spherical actuator surfaces 26, preferably adjustable through a path substantially parallel to said force receiving surface 24 and essentially perpendicular to said ball crank axis 23.

An arm of each said ball crank includes a force receiving surface 24 oriented substantially parallel to a plane extending radially from and parallel to said ball crank axis, and separated from said plane by the radius of said actuators 26. Said surface 24 is preferably substantially parallel to the plane of strings.

Said bridge means 20, with string bearing surface substantially arcuate about ball crank axis 23, preferably includes vertical adjusting means providing for movement of bridge surface 9 in a direction normal to the plane of the strings 4 for adjustment of string "action". Adjusting means is preferably provided by a single set screw 14 in a boss 17 on or rotating with said ball crank. Bridge component 20 is preferably supported at alternate end by action pivot pin 19, preferably located in or near the plane of the strings.

Adjustment of actuators is preferably from a line coaxial with the main axis of rotation 1, in a direction toward or away from the ball crank axis 23. That single adjustment affects both the effective length of the actuator crank arm and the effective length of the ball crank arm, thereby determining the displacement of the string anchors 21 when control arm 16 is moved. Adjustment means may be, for example, by linear adjusting screws 15 in FIG. 6A, or by other means.

The ball crank surface 24 is preferably cylindrically concave with its axis perpendicular to its axis of rotation 23, and further is preferably slotted at the crank end to allow clearance for cantilevered actuator arms or adjusters 15.

The location of Bridge pivot support 28 is preferably adjustable in a direction parallel to the strings in order to adjust intonation. Intonation adjustment lock means 28 (preferably locking screw means 29 extending through a slot in pivot support) locks support 28 in place after adjusting. The sliding of support 28 is preferably constrained to linear track means, preferably in the form of a slot in pivot support 28 or base 76, and corresponding pin means extending into slot from the remaining component.

c) For improved precision and to prevent losing tune after flat bends, the present invention may be implemented in combination with clamping of strings at the tuning head nut, as is known, or it may preferably be implemented using a zero fret 30 or fret roller, preferably in combination with string guide means 31 (preferably in the form of guide post bearings with axes substantially perpendicular to the plane of the strings, and having locking means beyond said guide means, for example, commercially available locking tuners 33 of the type that will tune a string in less than one full turn of the tuning post.

Figure 2D:
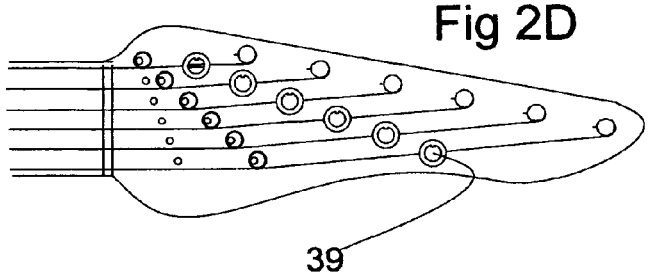
FIG. 2 is a top view of various embodiments of tuning head using zerofret and guide post improvements.
Figure 2A:
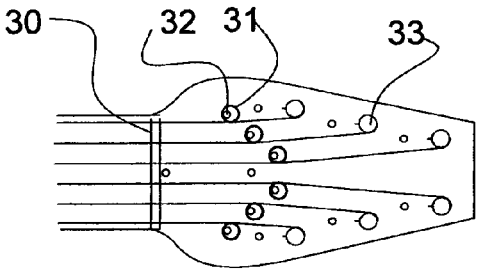
Figure 2E:
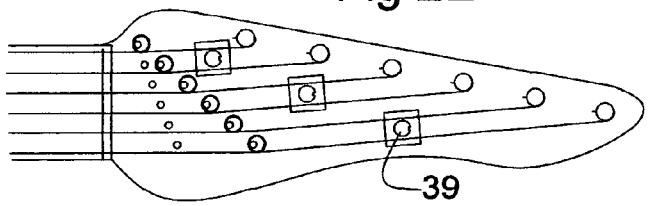
Figure 2B:
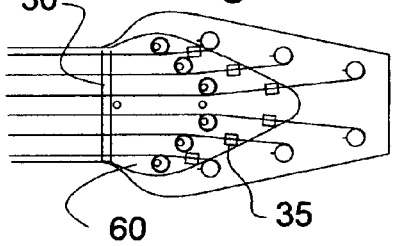
Figure 2F:
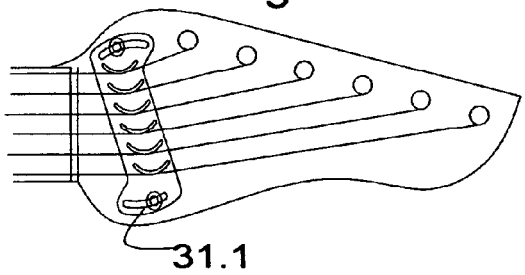
Figure 2C:
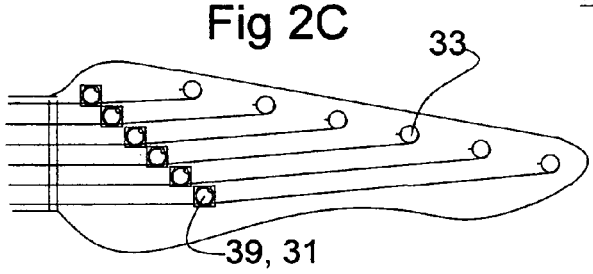
Figure 2I:
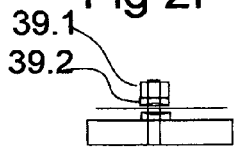

Alternate locking devices include simple threaded post 39, slotted or unslotted, preferably with keyed washer, as in FIGS. 2*c* and 2*d*. In FIGS. 2C and 2I clamping post 39, has a small unthreaded guide surface at its root, allowing it to also serve as the guide post 31.

In FIGS. 2*a,b,c,d* the guide post 31 preferably has adjustment means 32 for moving parallel to the zero fret, preferably by an eccentric having an axis substantially perpendicular to the string plane. Alternatively guide spacing may be adjusted by pivoting a multitude of guides about a single axis, for instance in the center or at one end of a gang casting 34 as in FIG. 2E, where pivot and locking means may be a simple screw into the tuning head.

The use of a guide post 31 beyond the zero fret 30 provides improved playability, allowing the "string bending" technique to be used with lower effort near the head end of the neck. Means for adjusting the position of guides in a direction parallel to the strings allows adjustment of "bendability". Said adjustment may be, by multiple choice of mounting locations 31.1, or by other means.

Alternatively, precisely or adjustably located locking tuners of the type previously described could provide some of the benefits of said string guides when used in combination with a zero fret and other components of the present invention. In FIGS. 11A and 11B tuners 33 are preferably mounted with the post through an eccentric, preferably tapered bushing 36, in a similarly tapered receiver hole in tuning head. An alternative adjustment uses a pivot pin or screw 34.1 perpendicular to face of tuning head, and an arcuate slot 34.2 about said pivot pin and through said tuning head perpendicular thereto. Loosening a lock nut on said tuner shaft and rotating said tuner in said arcuate slot allows variation of said string position, as in FIG. 11A.

The range of a flat plate vibrato device may be enhanced by locating tuning machines and guide posts on tuning head to define a tortured string path 37 for one or more minimally stretched strings (typically the lower pitched strings) as in FIG. 11A, or by choosing strings with heavier windings, or thinner cores, or lower modulus.

d) "Action height" adjustment, typically performed by cutting grooves into a nut and adjusting tension on a metal truss rod in prior art, may be improved by use of a zero fret 30 adjustable in a direction substantially perpendicular to the surface of the fingerboard. The zero fret is part of or joined to a support beam or flange 60, preferably elastically cantilevered about a bending axis parallel to said zero fret, and is adjustably secured from motion and vibration by any of a) compressive set screws, b) tensile hold down screws 61.2, flex modulus of flange 60, string tension acting on string bearing 35.

Figure 7A:
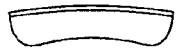
FIG. 7 is a cross section and side view of a composite neck having adjustable zero fret.
Figure 7B:
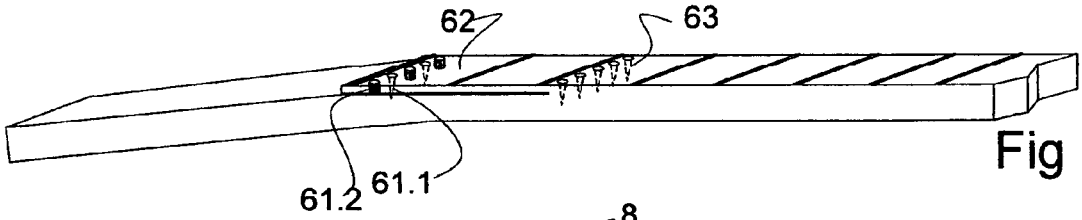

If the neck and fingerboard are of suitably high modulus, as in FIG. 7, the cantilever may be the extreme end 62 of the fingerboard itself, preferably having interlaminar reinforcement 63 at the line of separation from the neck, for example with anchor screws substantially perpendicular to the fingerboard. If the fingerboard and neck are molded as a single unit, said reinforcement may be in the form of fibrous stitching or belting through or around the longitudinal fibrous reinforcement of the neck and fingerboard, or rigid anchor means, preferably flat plates or a plate assembly, of high modulus material inserted substantially parallel to the length of the neck and perpendicular to the plane of the fingerboard.

e) The present vibrato invention may be made to retrofit onto an existing guitar, particularly one employing a removeable Gibson type bridge and tailpiece. Unit may be fabricated with anchor bolts 71 or bolt holes matching tailstock bolt pattern, and bridge height adjustment screws 72 either matching the existing threaded inserts, or riding on plate means 69 secured to said existing inserts, as in FIGS. 8*e*, 8*f* and 12.

A preferred retrofit tuning head flange assembly in FIG. 2B, for example to fit a typical Gibson tuning head, includes a flange 60, preferably of flat metal or composite material extending substantially over the tuning head, to which is attached a combination of a zero fret 30, string bearing means 35 to reduce string angle across zero fret, string guides 31 preferably having adjustment means 32 to adjust string spacing, vertical fret adjustment means 36 as previously described, and optionally string clamp means 39. Alternative to string clamp means, unit may include locking tuners mounted through or external to the flange. Preferably set screw height adjusting means 36 project into nut cavity, preferably distinct from alignment pin means extending into nut cavity, which rest against wall or walls of nut cavity.

Figure 2G:
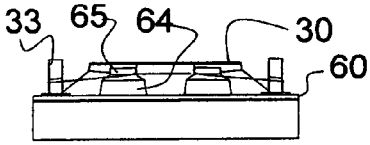
Figure 2H:
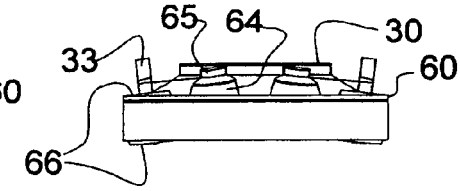

For retrofit for flange 60 onto severely raked tuning heads, as in FIGS. 2G and 2H, string bearing means 35 and string guide means 31 are preferably combined into a single roller 66 for each string, preferably having lateral adjusting means 36. With a beveled flange on said string bearing 35, boss 65 aligned with bearing axis may be normal to head face as in FIG. 9H, or preferably canted, as in FIG. 9G, with axis preferably normal to the plane of the string. Mounting of tuning machines 33 with axis normal to string plane at tuner, preferably on beveled bosses 67, aligns tuning machine 33 to guide roller 66.

f) The position of vibrato mechanism at rest or "home" position may be determined by the force of a tensile or compressive counterspring 40 acting against the tension of the strings, each forcefully engaging the rotating member 8, as is common in the prior art, and shown in FIGS. 5*b* and 6*a*.

The control bar 16 may engage the main rotating member 8 directly as in FIG. 6A and FIG. 6B, or it may engage the main rotating member through mechanical linkage, for example link arms 42 as in FIG. 10A or 10B, or cam means 43 as in FIGS. 9 and 5A, in order to achieve a desired purchase or direction of effort applied to the rotating member 8 for stretching or relaxing strings, or stability against drift and rebound.

A counter spring 41 may maintain string tension alternatively by engaging the control bar 16, rather than acting directly on the rotating member 8, thus eliminating any backlash effect of imprecision in control linkage.

Figure 9A:
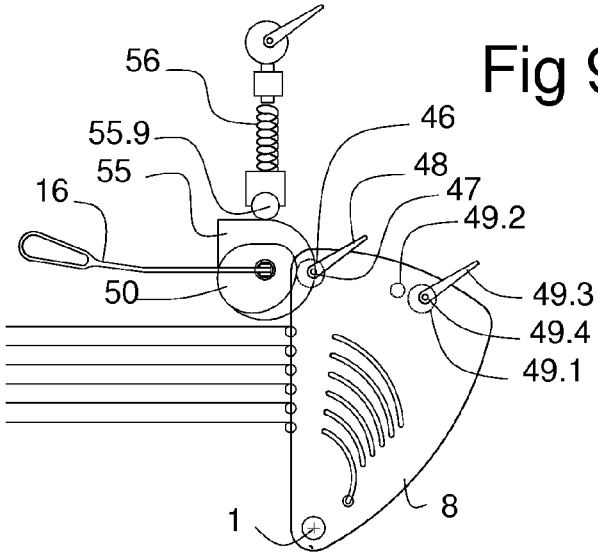
Figure 9G:
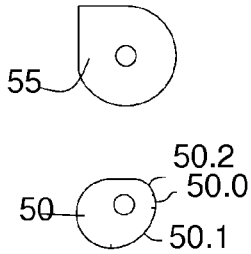
FIG. 9G through 9I are detail views of the cam means of FIGS. 9A through 9C.

Said counterspring or "balancing spring" force at rest is preferably adjustable using cam means 44 or adjusting screw means 45.

g) The preferred cam configuration in FIG. 9A and FIG. 9G utilizes a cam 50, preferably on an axis perpendicular to the plane of the strings, the force of said cam opposing the tension of the strings by acting on a cam follower 46, and said cam having at least one rest area of constant radius 50.0, with sharpening cam surface of increasing radius 50.1 on one side of rest, and flattening surface of decreasing radius 50.2 on other. Cam follower position, which determines resting pitch, is adjustable preferably by a lever 47 acting on an eccentric shaft.

With string tension on main member 8 pressing cam follower 46 into first cam 50, this first cam means creates increasing pitch when rotated in one direction from the rest and decreasing pitch when rotated in the other.

An optional second cam and cam follower means 49 (between rotating vibrato member and instrument body) acts as a low pitch stop, so that when control bar is released below the rest position of the main cam, the rotating member will stop at a low key defined by the player using second adjustment means, preferably a lever rotating said cam means. (note: the cam itself may be a simple cam follower on an eccentric shaft) Lever shaft has friction means, preferably in the form of locking spring washers on a friction plate, resisting rotation except by manually applied torque.

Said embodiment may be implemented with or without return spring means 56, preferably pressing a follower 55.9 against return cam 55, and preferably having adjusting means to allow precise return of cam to rest position when released.

An optional "upper" cam 50.9 in FIG. 14 includes a second sharpening surface 50.3 having higher slope and extending from first sharpening surface 50.1. The tactile sensation provided by this surface contacting the cam follower 46 alerts the player when strings have been stretched a predetermined distance, preferably a tonal half step.

Upper cam 50.9 and cam 50 may be combined into a single component, or they may preferably include angular adjustment means 50.7 to define the first tactile feedback point.

Preferably upper cam 50.9 includes an upper rest 50.4 surface of constant radius extending from the peak of sharpening surface 50.3 over the remaining useable circumference, serving to prevent breaking strings, prevent breaking necks, and preferably create a transposing rest at a fixed tonal distance (for example a full step) form said first rest 50.0.

An optional "lower cam" 50.8 includes the rest surface main 50.0, flattening surface of decreasing radius 50.2 of "center cam" 50.5, and preferably a low limit surface of constant radius, 50.6. Angular adjustment of lower cam with respect to sharpening cam surface 50.1, by adjuster 50.6 or separate adjuster, adjusts or eliminates the size of the rest 50.0 exposed to follower 46.

Figure 9B:
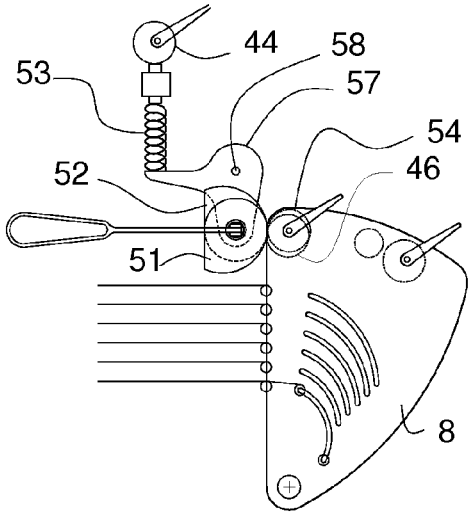
Figure 9H:
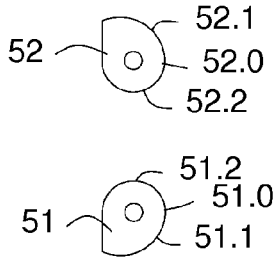

Said stack of cams may be further subdivided with additional rests and/or adjustable cams as needed.

h) A second preferred cam configuration in FIG. 9B and FIG. 9H utilizes preferably twin cam means (where second cam means may involve a separate cam or a second contact point on a first cam) each cam preferably rotating on a common axis.

A first cam means 51 has a rest surface 51.2 of constant radius over much of its useable circumference, and sharpening surface means 51.1 of increasing radius extending from the meeting of the two surfaces at root 51.0.

With string tension on main member 8 pressing cam follower 46 into first cam 51, this first cam means creates increasing pitch when rotated from the root 51.0 in the direction of increasing radius, and no tonal change when moved in the other. Cam means 51 may include the features of upper cam means 50.9.

A flattening cam 52 has a rest surface 52.2 of constant radius and flattening surface 52.1 of increasing radius extending from the meeting of two surfaces at root 52.0

Sharpening spring means 53, directly or indirectly forces cam follower 51 toward "home position" until further motion is prevented by contact of second cam 52 with home stop (or cam follower) 54 fixed rigidly with respect to instrument body. Cams 51 and 52 are each rotatable with respect to a common transport means 57 (preferably a flattening crank pivoting on axis 58 parallel to main cam axis).

Said spring 53 is preferably of adequate spring rate and deflection to resist further deformation when cam 51 stretches strings to the maximum.

Figure 9C:
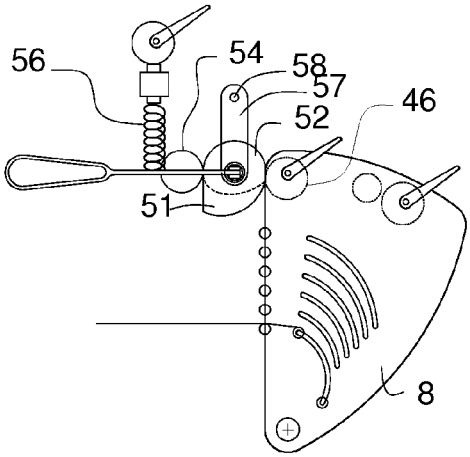
Figure 9I:
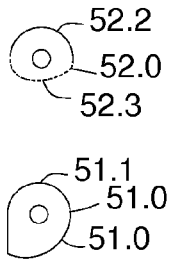

Preferably, rotating control arm 16 in a second direction progressively reduces string pitch by engaging stop 54 with the flattening surface of increasing radius 52.1, thus moving flattening transport means 57, and thereby moving first cam 51 away from "home" position, allowing follower 46 to follow.

i) The third cam embodiment in FIG. 9C varies from that in FIG. 9B, in that flattening cam 52 includes a flattening surface 52.3 of decreasing radius from the root 52.0. Rather than the sharpening spring 53 of the prior example, it is the rigidity of the combination of home stop cam 54 (substantially fixed with respect to instrument body) against the constant radius 52.2 of flattening cam 52 that holds the transport 57 (and actuator cam 51) in home position until the decreasing radius of flattening surface 52.3 is engaged, preferably by rotating control arm 16 in said second direction.

Further, return spring 56 acting with mechanical advantage through flattening cam 52, expends far less effort than sharpening spring 53 of FIG. 9B.

j) In a fourth embodiment using cam control, said second direction of rotation of control arm 16 for is in a different plane (preferably at right angles) from that used to sharpen string tone in FIGS. 9B and 9C.

This may be accomplished by simple linkage to the coaxial cam axes previously described, or it can be accomplished by rotating the flattening cam 52 of FIGS. 9B and 9C into a second plane preferably perpendicular to sharpening cam 51.

FIGS. 9*d* and 9*e* show further embodiments of the basic principle of FIG. 9*c*, wherein second control axis rotates with respect to the first. Transport means 57 includes sharpening cam means 51 in a single component, and is displaceable either linearly (FIG. 9D) or angularly (FIG. 9E) with respect to base means 70, rotating about an axis fixed with respect to instrument body. Control arm 16 is fixed to base in preferably the first rotational plane and pivots with respect to base in the other.

An advantage of sharpening and flattening motions being divided into two planes is that control arm 16 may be swung away from strings without effect on pitch, but may be pressed in a direction perpendicular to string plane to lower pitch, whereas pulling control arm toward strings about an axis perpendicular to sting plane increases pitch. Another advantage is that overshooting the root when returning from a bend will have no effect on string pitch as with other devices (unless the cam is specially cut for that effect, for example)

In advantageous alternate setups, one of the two cams may be a full range cam 50.5 (as in FIG. 9A) while the other covers a similar range, but with no center rest 50.0.

Cams may act directly or indirectly through cranks and rockers.

The large constant radius areas on certain cams help prevent audible mechanical shock at the end of a stroke, to allow overshoot without audible error, and to allow flexibility and tolerance during setup.

k) In the preferred embodiment a combination of 2 or more springs would be used. The first spring (a balancing spring 40) is preferably adjustable, and preferably acts on the main rotating member, opposing the tension of the strings, in order to reduce the effort required for the performer to stretch the strings to a sharper pitch. Adjustment of said balancing spring will determine the amount of effort required to move rotating member 8 away from home position. Balancing spring 40 may be used in conjunction with sharpening spring 53 of FIG. 9B to further define the effort required in sharpening and flattening actions.

One or more secondary springs acting on the control arm or on cams or linkage attached thereto compensate for string and first spring forces, particularly when the string pitch is bent flat, thereby allowing the control arm to return to home position or reducing the effort required for the user to return it to home position.

One or more third spring means may act on the arm or on detents to assist in forcing the arm into or out of adjustable detents for selecting alternative arm positions.

Preferably said first balancing spring may be adjusted to optionally completely balance the string tension at base tuning, thereby allowing main rotating member 8 to float freely without constraint by cams and stops.

Note that, while coil springs are generally depicted here for schematic purposes, it is anticipated that any spring configuration fitting the application may be applied. In FIG. 12, a base plate 69 used to retrofit the current device to an existing body may be of spring steel material having a cantilevered balancing spring 40 cut into said plate and preferably rigidly or pivotably linked to rotating member 8.

In the prior configurations, the force exerted by balancing spring 40 is less than to total opposing force of the strings, and effort by the control arm is required to stretch the stings to a higher pitch.

In alternative configuration shown conceptually in FIG. 9F, balancing spring 40 is energizised to exert force adequate to stretch the strings to their highest allowable pitch, and the force of main control cam 50, upon main cam follower 46 (the axis of one of which is fixed with respect to the rotating member, and the other with respect to the body) opposes the force of spring 40. When cam 50 rotates to reduce its force on follower 46, the balancing spring 40 moves the main rotating member to increase the tension on the strings. Return spring 41, acting directly or through linkage or return cam 55 and return cam follower 55.9, opposes the sharpening motion of the control arm 16 and returns it to neutral when it is released. The benefit of this configuration is that a broken string will have no effect on the pitch of the remaining strings or the as might another configuration if the force on balancing spring 40 were excessive.

l) Because of the massive scale of the present invention and low angle of rotation as compared with prior art tremolo devices, string guide means may be visually placed by measurement or by index marks included on the device, and a small error in placement will be undetected acoustically. Further, because of the low angle of rotation, to resolve conflicts of space, a string may be wrapped about the geometrically wrong side of said guide or about a guide in a geometrically incorrect track without significant harm to acoustic accuracy.

An embodiment of the invention taking advantage of said tolerance in a flat plate configuration may use fewer than the total complement of arcuate paths. It may also use additional (for example parallel to the high e) non converging paths to allow flexibility in setting up said device for multiple tuning. Where multiple paths converge near the main pivot axis, one may continue while the others terminate short of the convergence point.

m) Additional Notes:

Previously described pitch adjusting lever means may be installed on either first cam follower or second cam follower, or both.

Any alternative means of engaging vibrato device may be applied, for example a foot pedal with flexible cable coupled to the control cam, or coupled directly to the main rotating member.

Rotation of control arm in two planes may be used to perform 2 differing tonal adjustments, for instance bending the b-string or some other subset of strings may be assigned to rotation in one plane, while rotation in the other plane affects the entire string complement.

Alternatively, the two planes of rotation may serve similar functions, for instance similar cam operation, but with differing cam slopes and rests.

Alternatively rotation in one plane may be used to set and release locking mechanism or brake for the rotation in the other plane.

Likewise a foot pedal or other mechanism may operate in conjunction with one or more planes of control bar rotation, as may be required to perform any of the various functions.

Control arm 16 preferably has control surfaces engageable by players fingertips substantially perpendicular to each major direction of motion, as in FIGS. 9A and 9D. In an alternate embodiment, one or more projections 73 project substantially radially from an arcuate control arm 16, providing a means to an improved playing technique, as in FIG. 12A. FIG. 12B shows an alternative embodiment wherein control arm extends under pick guard or other solid surface means 79. Control end 73 may extend in any direction.

An advantage of the present invention is that transposing to an alternate key may be accomplished by adjusting the position of the cam follower 46 with respect to the main rotating member 8 (preferably by lever action as described), or by adjusting the position of the control arm cam pivot axis 60 (preferably by similar means). Thus the main control arm 16, foot pedal, or other main control continues to be fully expressive.

A preferred method of applying spring force to main control arm is by a sprung cam follower means acting on a separate cam mounted on main pivot axis, cut to provide counteracting torsion only when cam arm is rotated to lower string pitch, as in FIG. 9A. Cam follower may be a simple low friction surface or rotating bearing surface.

String bearing means may serve also as bridge saddle means.

String guide means and string anchors may be combined in a single component.

Note: Mechanical construction listed above is by way of example and conceptual schematic only. Any configuration functioning according to the described principles falls within the scope of this invention. In particular switching locations of cams and cam followers, rotating axes, and utilization of mechanical linkage in place of cams, or vice versa, falls under the scope of this invention.

The "substantially accurate" adjusting path of string guides on a flat plate embodiment may extend to include slots or discrete holes having arcuate or linear configuration.

The invention resides in the specification and claims and in those improvements and modifications which may become obvious to those skilled in the art.

I claim:

1. A pitch changing device for musical instrument, said instrument having a body, multiple substantially parallel strings defining a substantially common string plane, one end of the major span of said strings defining a bridge where said device comprises in combination:

a first member rotatable about a main axis fixed relative to a base, multiple string anchors located fixedly or adjustably with respect to said first member, multiple string guides associated adjustably with said first member, each guide configured to engage a string and defining a radius from said main axis of engagement between said string and said first member, positioner or positioners enabling adjustment of the position of said string guides relative to said first member, multiple string bearings, each bearing fixed or adjustable from a home position relative to said base, and configured to engage a string at a point between said string's engagement with a guide and said major span of said string, where each of at least two said guides is substantially constrained by its associated positioner to a path approximating an arc having an axis substantially parallel to said main axis and located relative to said first member in the area generally between said main axis and the string bearing associated with said guide.

2. A pitch changing device according to claim 1, where each of at least two said guides is adjustably positionable along a path relative to said first member, where, at rest, the string or the axis of the string associated with said guide, extending from engagement of said string with a string bearing at its home position, intersects the guide at a point of substantial tangency, or substantially common angle from tangency, to an arc centered on said main axis.

3. A device according to claim 1, where at least one said guide positioner comprises a substantially radial support member adapted to support an associated guide and to define its radius from a guide path axis substantially fixed relative to said first member, and an adjuster adapted to define or limit the rotation angle of said radial support member about said guide path axis relative to said first member.

4. A device according to claim 3 having main axis substantially parallel to the plane of the strings and in a plane substantially perpendicular to the strings themselves.

5. A device according to claim 1, where the axis of an arc approximated by at least one said guide path is located, relative to said first member at rest, approximately half way between said main axis and said home position of a string bearing associated with said guide.

6. A device according to claim 1 where said main axis is substantially perpendicular to a plane described by the strings in the vicinity of said first member.

7. A device according to claim 6 where said first member comprises a plate having a surface substantially perpendicular to said main axis.

8. A device according to claim 1 where at least one said string bearing member comprises a bridge saddle rollers having string constraining groove surfaces oblique to the plane of said strings and to the roller axis of rotation.

9. A device according to claim 8, comprising at least one string bearing positioner enabling adjustment of a string bearing position along at least one axis relative to said base.

10. A device according to claim 7, where a said guide positioner comprises, for an associated string guide, a slot in said plate, said slot substantially defining the path of said guide relative to said plate.

11. A device according to claim 1, where changes in string pitch are measured in each direction from a position of neutral string pitch, and further comprising:

a control lever, mechanically associated with said first member and said base, through which lever said device may be forcefully engaged by the user to adjust rotation of said first member about said main axis, a shaft or journal, fixed relative to said base or said first member, defining a control axis about which said control lever rotates, a cam mechanism comprising first and second cam components, one component comprising a cam and the other comprising a cam follower, a return spring forcing engagement of said first cam component with said second cam component, where said first cam component is associated with said control lever, and said second cam component is associated with said first member or base, where the cam of said cam assembly comprises a return surface acting substantially in a single rotational direction from an angular position of neutral string pitch, such that rotation of said lever from a position of neutral string pitch in one direction is opposed by the force of said return surface on said cam follower, and rotation in the other direction is relatively unopposed by said cam and follower.

12. A device according to claim 1, and further comprising one or both of:

a low limit stop defining the angle of rotation of said first member about said main axis relative to said base when said device is fully detuned, an adjuster enabling the positioning of said stop, where said adjuster comprises at least one displacing element selected from a group of cam, eccentric, and screw.

13. A control for a pitch changing mechanism according to claim 1, said mechanism comprising a first member moveable relative to a base or to said instrument body and adapted to increase the tension on said strings when moved in a first operative direction, and to decrease the tension on said strings when moved in a second direction, said control comprising a lever, a first fulcrum associated with said lever and enabling pivot of said lever about a first axis, a second fulcrum enabling pivot of said lever about a second axis, a fulcrum connector engaging first and second fulcrums such that first and second axes are fixed relative to said fulcrum connector, where said lever rotates about said first fulcrum axis relative to said connector, and said connector rotates about said second axis relative to said base or body, a cam mechanism comprising first component associated with said lever and second component associated with said base or body, one of said components comprising a cam having a displacing surface, and the other comprising a cam follower, a bias spring associated with said connector, and urging said first and second cam components together, where said lever is associated with mechanical link to said first member, such that rotation of lever in first direction about said first axis causes motion of first member in a direction of increasing string tension, where rotation of said lever in a second direction about said first axis increases engagement of said displacing surface with said follower, displacing said first axis from said second cam component in opposition to said bias spring.

14. A device according to claim 1, comprising a control lever, mechanically associated with said first member and said base, through which lever said device may be forcefully engaged by the user to change the angle of rotation of said first member about said main axis.

15. A control device for a pitch changing mechanism on a stringed instrument, said mechanism comprising a first member moveable relative to a base or to said instrument body and adapted to increase the tension on said strings when moved in a first operative direction, and to decrease the tension on said strings when moved in a second direction, said device comprising, where changes in string pitch are measured in each direction from a position of neutral string pitch, a control lever, adapted to be mechanically associated with said first member and said base, through which lever said device may be forcefully engaged by the user to move of said first member relative to said base, a shaft or journal, adapted to be fixed relative to said base or said first member, defining a control axis about which said control lever rotates, a cam mechanism comprising first and second cam components, one component comprising a cam and the other comprising a cam follower, a return spring adapted to urge engagement of said first cam component with said second cam component, said first cam component associated with said control lever, and said second cam component associated with said first member or base, where the cam of said cam assembly comprises a return surface acting substantially in a single rotational direction from an angular position of neutral string pitch, such that rotation of said lever from a position of neutral string pitch in one direction is opposed by the force of said return surface on said cam follower, and rotation in the other direction is relatively unopposed by said cam and follower.

16. A control device for a pitch changing mechanism on a stringed instrument, said mechanism comprising a first member moveable relative to a base, said first member adapted to increase the tension of said strings when moved in a first operative direction, and to decrease the tension of said strings when moved in a second operative direction, said device comprising a lever, a first fulcrum associated with said lever and defining lever about a first axis, a second fulcrum defining lever about a second axis, a fulcrum connector adapted to engaging said first and second fulcrums, such that said first and second axes are fixed relative to said fulcrum connector, said lever pivotable about said first axis relative to said connector, said connector pivotable about said second axis, a cam mechanism comprising a first component associated with said lever and a second component adapted to be associated with said base, one of said components comprising a cam having a displacing surface, and the other comprising a cam follower, at least one spring associated with said connector, said spring adapted to urge rotation of said connector in a direction urging engagement of said first component with said second component, said device adapted to engage said first member such that the force of said spring on said connector urges said first member in said first operative direction, said engagement of said first and second components adapted to displace said connector in a direction opposing said spring upon rotation of said lever in one direction, such that said displacement of said connector enables said string tension to displace said first member in said second operative direction.

17. A pitch changing device for a stringed musical instrument, said instrument comprising multiple strings suspended in tension over a major span, said device comprising:

a main fulcrum adapted to define a main axis having an orientation substantially normal to a plane substantially defined by said strings, a first member, rotatable within an operative angle about said main axis relative to a base, and adapted to operatively engage at least two of said strings outside said major span length of said strings, multiple string guides, at least one said guide adapted to be adjustably positioned at an operative location fixed relative to said first member, each said guide adapted to engage a string, multiple string bearings, at least one bearing adapted to be fixedly or adjustably attached relative to said base, each bearing adapted to engage a string along the length between said string's engagement with a guide and said major span of said string, said main fulcrum adapted to pivotably connect said first member to said base, a positioner enabling adjustment of the location of said guide relative to said first member where the degree of adjustment provided by said positioner is sufficient to enable engagement between an associated guide and string at a position suitable to define a radius of engagement between said first member and said string during rotation of said of first member about said main axis within said operative angle, such that engagement of said strings with said guides and bearings causes an increase or decrease in string tension when said first member is rotated about said main axis relative to said base.

18. A device according to claim 17, and further comprising a roller saddle having a roller axis substantially perpendicular to a plane substantially defined by said strings.

19. A device according to claim 17 where said first member comprises a plate, and at least one positioner comprises a slot in said plate and a fastener, said slot adapted to receive said fastener, said fastener adapted to secure the position of said guide relative to said plate, said plate adapted to pivot about said main axis with said main axis substantially normal to said plate.

20. A device according to claim 19 where at least one said guide comprises a cylindrical post adapted to be secured to said plate with a coaxial threaded fastener, the axis of said post normal to said plate, said post further adapted to engage a string wrapped angularly about said post.

21. A device according to claim 20 where said first member comprises multiple string anchors, each adapted to connect an end of a sting to said first member, the anchor and positioner associated with said string adapted to position a guide in operative engagement with said string at a location along the string between its engagement with an anchor and a bearing.

22. A device according to claim 21 where at least one said anchor comprises a slot extending inwardly from an edge of said plate, said slot having a width narrower than the ball end of a string.

23. A pitch changing device for a musical instrument, said instrument comprising multiple strings, each string adapted to be suspended in tension between first and second supports, said supports defining a major span of said string, where said device comprises in combination:

a main fulcrum defining a main axis, said main axis fixed relative to a base, a first member rotatable about said main axis, said first member associated with at least two string anchors and at least two string guides, each said string anchor adapted to fixedly or adjustably anchor one end of a said string with respect to said first member, each said guide adapted to engage a string in a manner defining from said main axis a radius of engagement between said string and said first member, at least two string bearings, each said bearing adapted to engage a string at a location between said first member and said major span of said string, at least one guide positioner, said positioner adapted to enable adjustment of the position of at least one said string guide relative to said first member along a path approximating an arc, said arc focused on a second axis substantially parallel to said main axis, said second axis located in a region approximately between said main axis and a said string bearing associated with said string.

24. A device according to claim 23 where the path and range of adjustment of said at least one positioner enables positioning said at least one guide, such that rotation of said first member from a neutral position causing a change of pitch in one string by one musical half step results in an equivalent change of pitch in at least one other string.

* * * * *